US010975556B2

(12) United States Patent
Tsai

(10) Patent No.: US 10,975,556 B2
(45) Date of Patent: Apr. 13, 2021

(54) TANK-LESS AUTOMATIC FLUSH TOILET

(71) Applicant: Tien-Shou Tsai, Taichung (TW)

(72) Inventor: Tien-Shou Tsai, Taichung (TW)

(73) Assignee: Tien-Shou Tsai, Taichung (TW)

( * ) Notice: Subject to any disclaimer, the term of this patent is extended or adjusted under 35 U.S.C. 154(b) by 1 day.

(21) Appl. No.: 16/515,326

(22) Filed: Jul. 18, 2019

(65) Prior Publication Data

US 2021/0017748 A1 Jan. 21, 2021

(51) Int. Cl.
*E03D 1/18* (2006.01)
*E03D 5/10* (2006.01)

(52) U.S. Cl.
CPC ..... *E03D 1/186* (2013.01); *E03D 5/105* (2013.01)

(58) Field of Classification Search
CPC ..... E03D 5/105; E03D 1/186
USPC ..... 4/302, 313, 326
See application file for complete search history.

(56) References Cited

U.S. PATENT DOCUMENTS 3,193,846 A * 7/1965 Lefebvre ..... E03D 5/10 4/313
5,652,968 A * 8/1997 Kodaira ..... E03D 5/10 4/313
5,950,983 A * 9/1999 Jahrling ..... E03D 5/105 4/313
7,325,781 B2 * 2/2008 Parsons ..... E03D 5/105 4/302
8,407,821 B2 * 4/2013 Chan ..... E03D 5/105 4/406

* cited by examiner

*Primary Examiner* — Tuan N Nguyen
(74) *Attorney, Agent, or Firm* — TraskBritt

(57) ABSTRACT

A tank-less automatic flush toilet includes a toilet stool, a pipe unit, an electric switching valve, a manual switching valve, and a sensor control unit. The pipe unit includes a flow-in pipe, a flow-out pipe which is upstream of a toilet bowl of the toilet stool, a first bypass pipe which is fluidly connected to the flow-in pipe, and a second bypass pipe which is fluidly connected to the flow-out pipe. The electric switching valve is connected in series between the flow-in and flow-out pipes. The manual switching valve is connected in series between the first and second bypass pipes. The sensor control unit is disposed for controlling the switch of the electric switching valve between a blocked state and a communicated state.

8 Claims, 15 Drawing Sheets

TANK-LESS AUTOMATIC FLUSH TOILET

FIELD

The disclosure relates to a flush toilet, more particularly to a tank-less automatic flush toilet.

BACKGROUND

A conventional flush toilet includes a toilet stool and a water tank for providing water to flush away excreta. However, the water tank occupies quite a large space, especially in a limited toilet space, and also affects the sense of space for the toilet space. Aside from this, elements inside the water tank are connected in complicated ways for controlling the water flushing. The provision of those elements may increase the production cost and maintaining cost for the flush toilet.

SUMMARY

Therefore, an object of the disclosure is to provide a novel tank-less automatic flush toilet which may overcome at least one drawback of the prior art.

According to the disclosure, a tank-less automatic flush toilet includes a toilet stool, a pipe unit, an electric switching valve, a manual switching valve, and a sensor control unit. The toilet stool defines therein a toilet bowl. The pipe unit includes a flow-in pipe, a flow-out pipe which is upstream of the toilet bowl, a first bypass pipe which is fluidly connected to the flow-in pipe, and a second bypass pipe which is fluidly connected to the flow-out pipe. The electric switching valve is connected in series between the flow-in and flow-out pipes, and is switchable between a blocked state, where fluid communication between the flow-in and flow-out pipes is blocked, and a communicated state, where the flow-in and flow-out pipes are fluidly communicated with each other. The manual switching valve is connected in series between the first and second bypass pipes, and is switchable between a closed state, where fluid communication between the first and second bypass pipes is closed, and an open state, where the first and second bypass pipes are fluidly communicated with each other. The sensor control unit is disposed for controlling the switch of the electric switching valve between the blocked state and the communicated state.

With the provision of the pipe unit in cooperation with the electric switching valve and the manual switching valve, the water flow in the pipe unit can be used for directly flushing the toilet bowl. Therefore, the water tank for the conventional flush toilet can be omitted for saving space in a toilet and for improving the sense of space of the toilet space. In addition, the electric switching valve is controlled by the sensor control unit to switch between the blocked state and the communicated state, thereby achieving automatic flushing. Under a blackout condition, the manual switching valve may be manually switched to the open state for flushing the toilet bowl.

BRIEF DESCRIPTION OF THE DRAWINGS

Other features and advantages of the disclosure will become apparent in the following detailed description of the embodiment (s) with reference to the accompanying drawings, in which.

DETAILED DESCRIPTION

Figure 1:
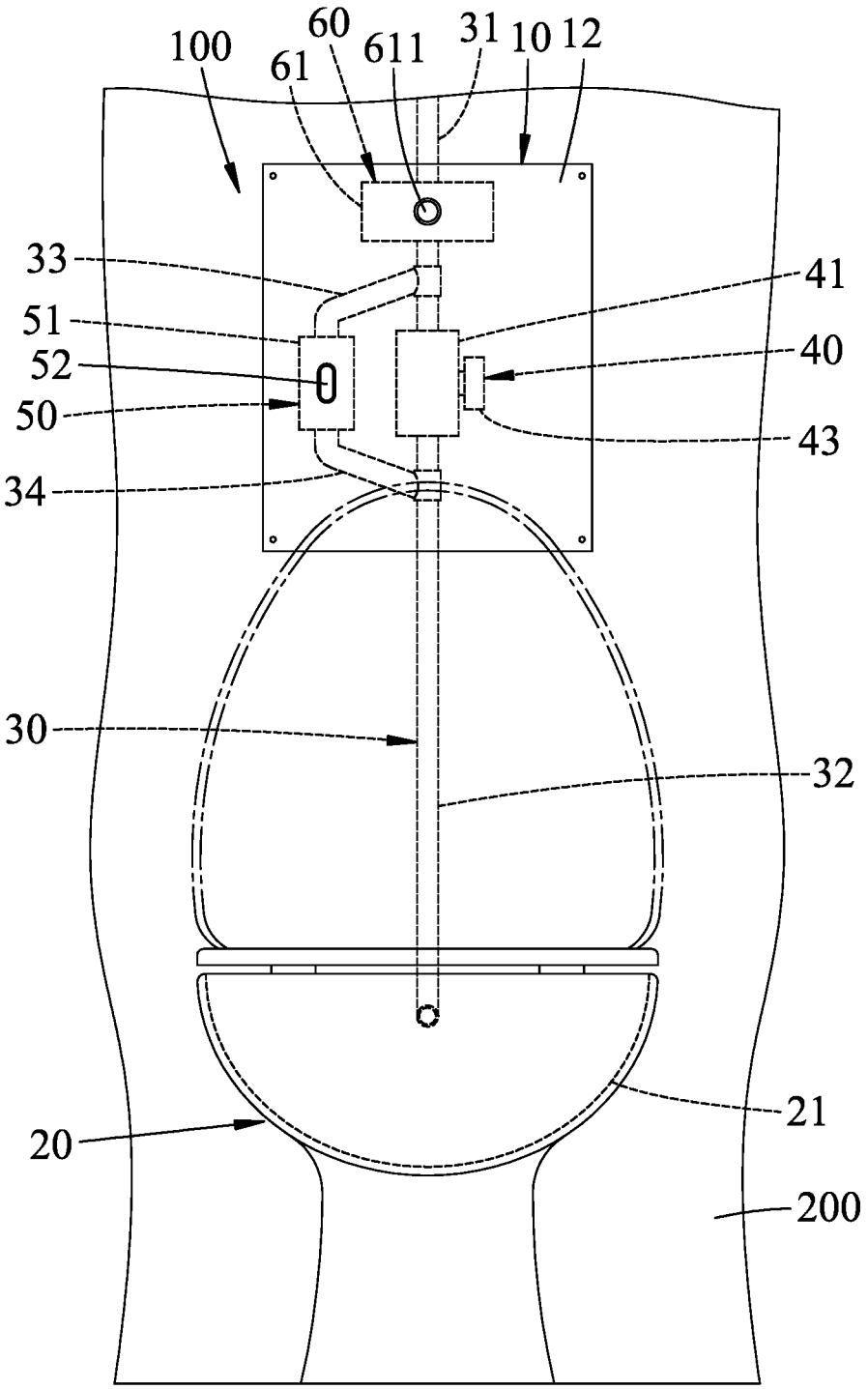
FIG. 1 is a fragmentary front side view of a tank-less automatic flush toilet according to a first embodiment of the disclosure.

Before the disclosure is described in greater detail, it should be noted that where considered appropriate, reference numerals have been repeated among the figures to indicate corresponding or analogous elements, which may optionally have similar characteristics.

Figure 2:
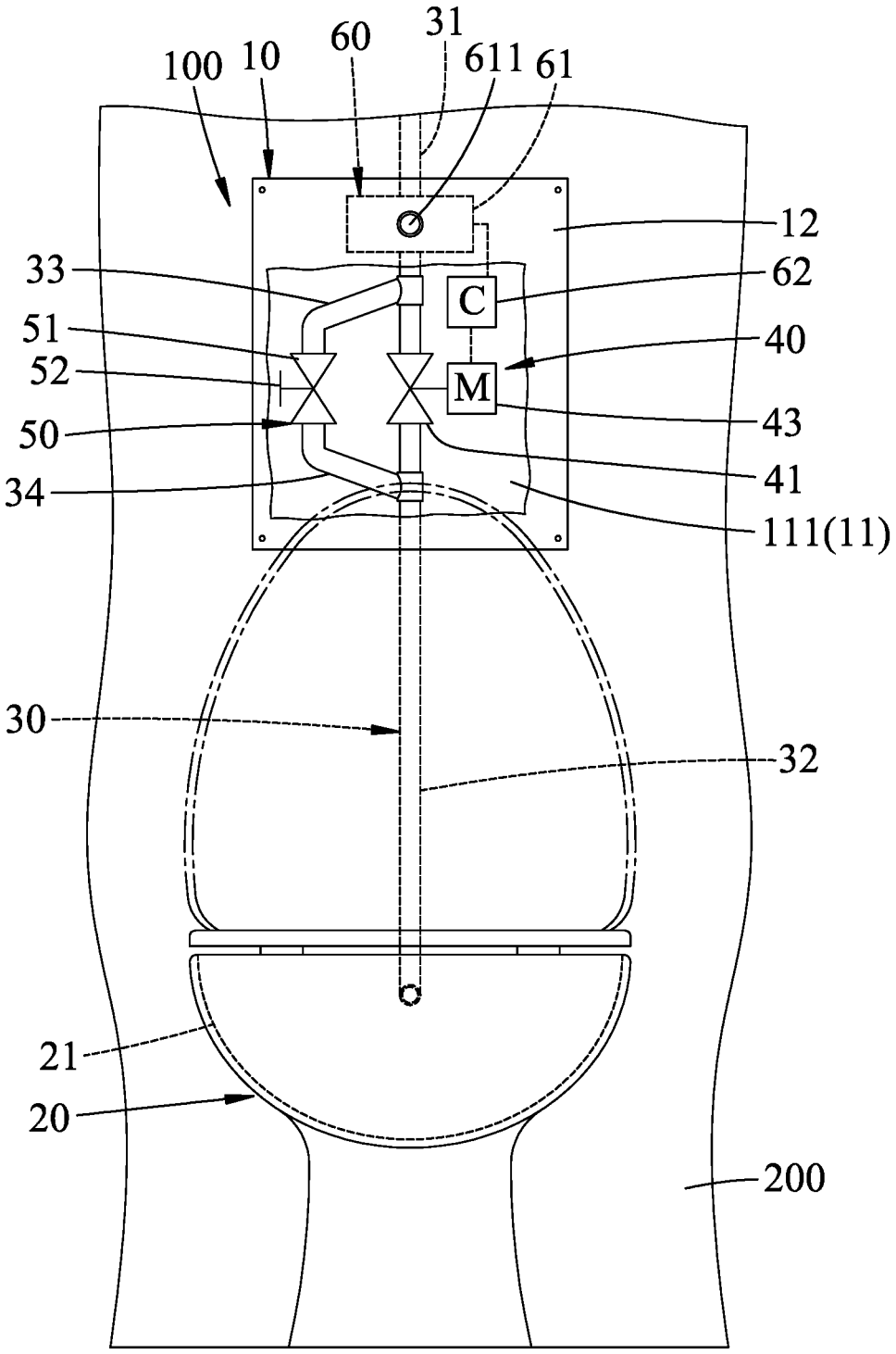
FIG. 2 is similar to FIG. 1 but with a cover plate being partially cut-out for illustrating relations among a pipe unit, an electric switching valve, and a manual switching valve inside an embedded box.
Figure 3:
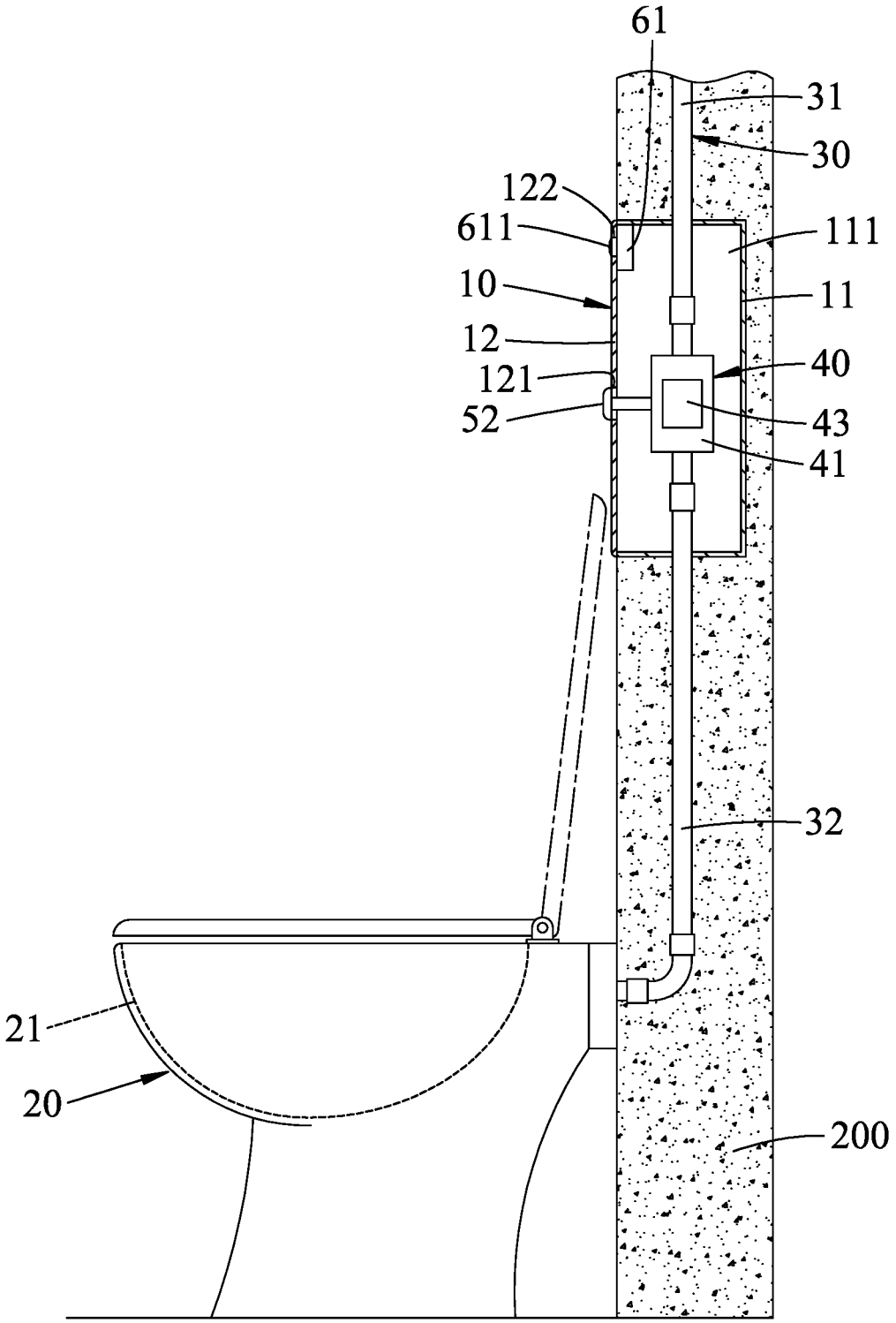
FIG. 3 is a fragmentary, partially cross-sectional view of the first embodiment and a wall.

Referring to FIGS. 1 to 3, a tank-less automatic flush toilet 100 according to a first embodiment of the disclosure is shown to include an embedded box 10, a toilet stool 20, a pipe unit 30, an electric switching valve 40, a manual switching valve 50, and a sensor control unit 60.

The embedded box 10 includes a box body 11 and a cover plate 12. The box body 11 is embedded in a wall 200, and defines therein an installation space 111. The cover plate 12 is detachably mounted to the box body 11 to enclose the installation space 111.

The toilet stool 20 defines therein a toilet bowl 21. In the first embodiment, the toilet stool 20 is in the form of a sitting toilet.

The pipe unit 30 includes a flow-in pipe 31, a flow-out pipe 32, a first bypass pipe 33, and a second bypass pipe 34. The flow-out pipe 32 is disposed downstream of the flow-in pipe 31 and upstream of the toilet bowl 21. The first bypass pipe 33 is fluidly connected to the flow-in pipe 31. The second bypass pipe 34 is fluidly connected to the flow-out pipe 32. In the first embodiment, the flow-in pipe 31 is embedded in the wall 200 and extends downwardly into the installation space 111. The flow-out pipe 32 is embedded in the wall 200 and extends upwardly into the installation space 111. The first and second bypass pipes 33, 34 are disposed in the installation space 111.

Figure 4:
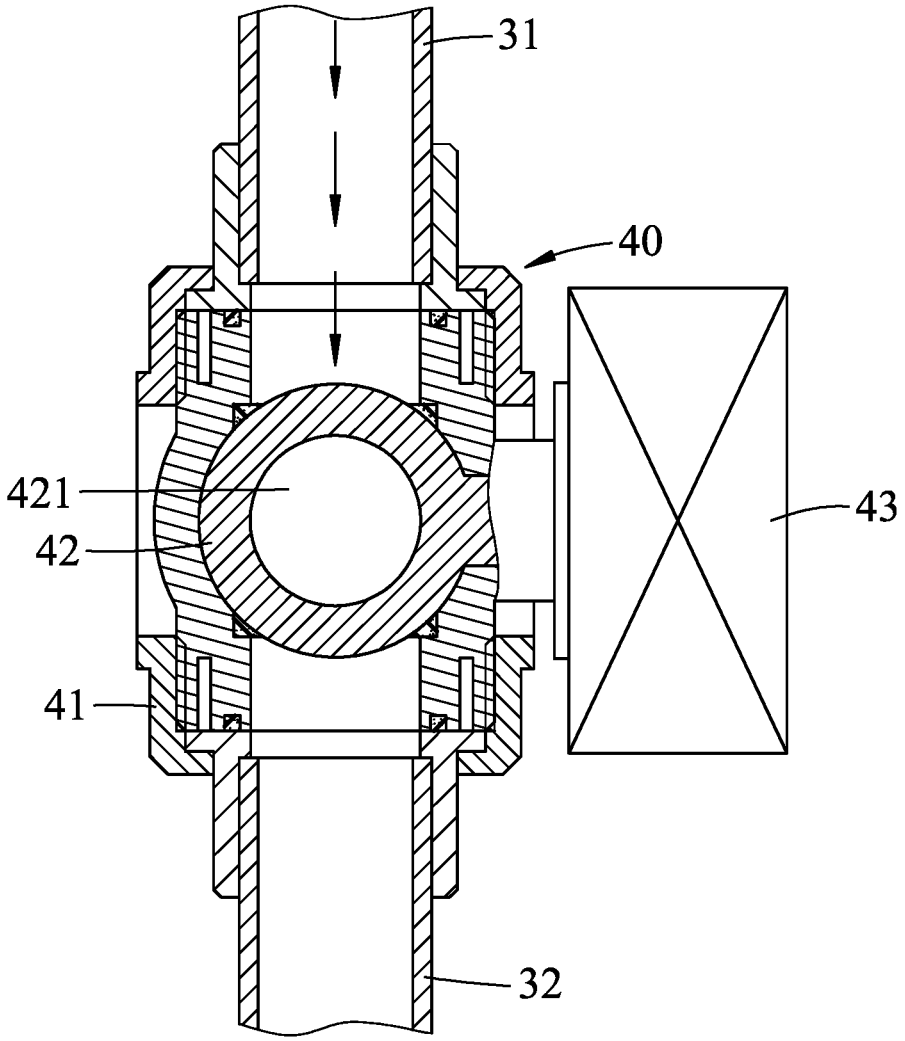
FIG. 4 is a fragmentary, partially cross-sectional view of the pipe unit and the electric switching valve which is in a blocked state.
Figure 5:
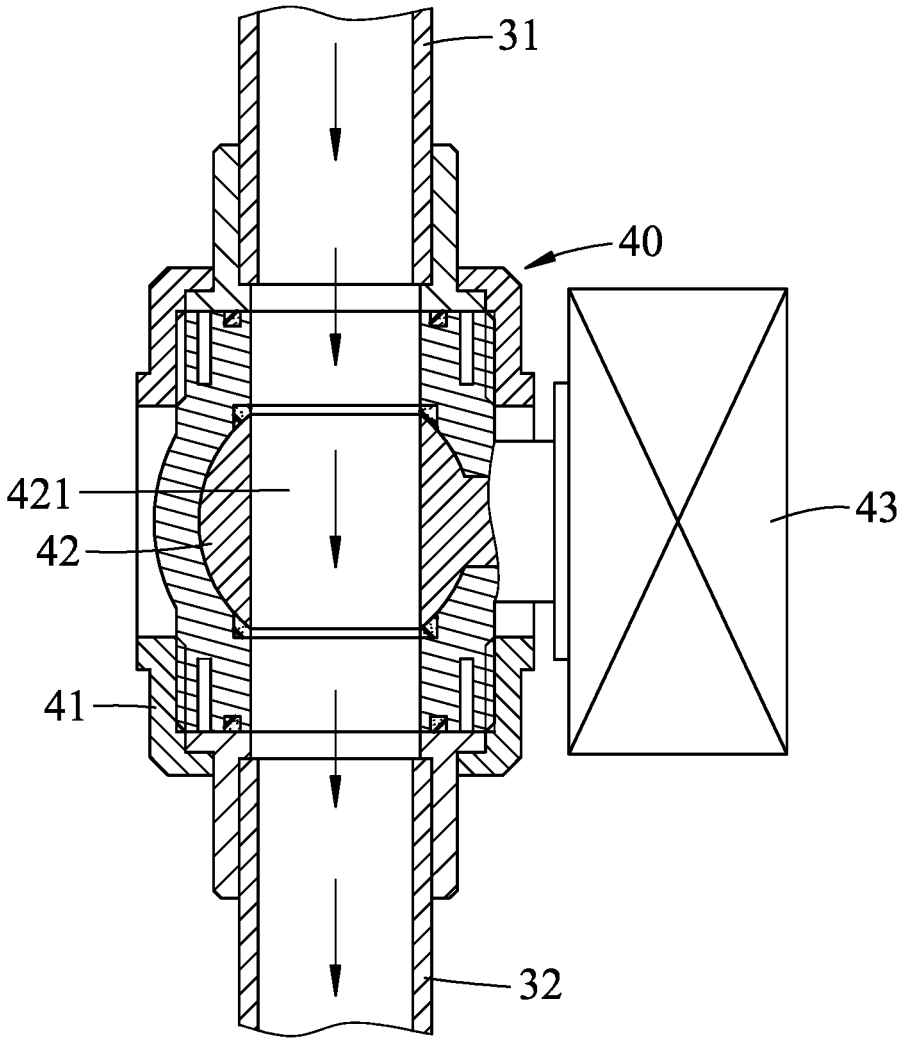
FIG. 5 is similar to FIG. 4 but illustrating the electric switching valve in a communicated state.
Figure 9:
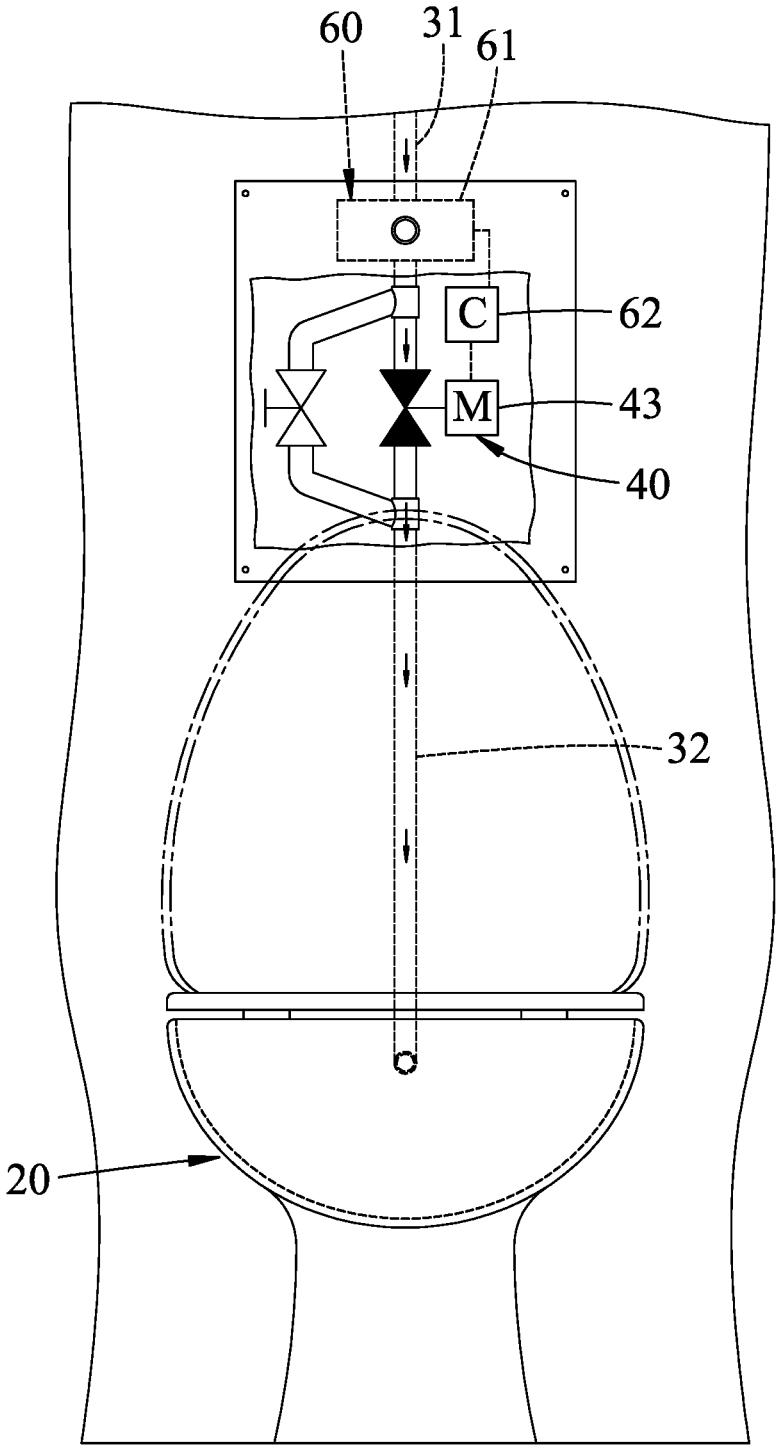
FIG. 9 is similar to FIG. 7 but illustrating the electric switching valve in the communicated state and the manual switching valve in the closed state.

The electric switching valve 40 is connected in series between the flow-in and flow-out pipes 31, 32, and is disposed in the installation space 111. The electric switching valve 40 is switchable between a blocked state (FIGS. 4 and 7) and a communicated state (FIGS. 5 and 9). In the first embodiment, as shown in FIGS. 4 and 5, the electric switching valve 40 is an electric ball valve which includes a valve body 41, a valve gate 42, and a drive motor 43. The valve gate 42, which is in the form of a ball, is rollably disposed inside the valve body 41, and has a communication hole 421. The drive motor 43 is disposed on the valve body 41 for driving the rolling of the valve gate 42.

Figure 7:
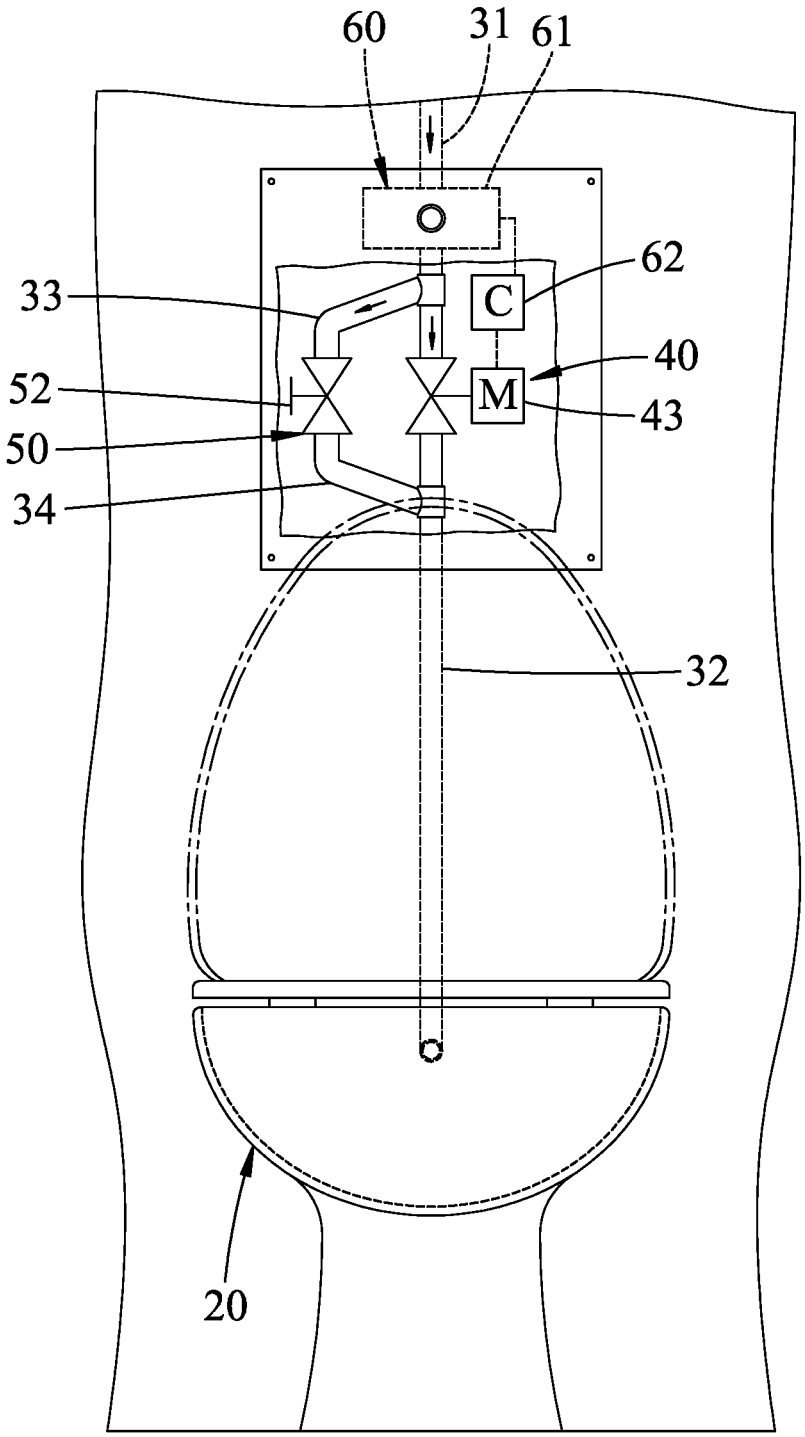
FIG. 7 is similar to FIG. 2 and illustrating the electric switching valve in the blocked state and the manual switching valve in a closed state.

As shown in FIGS. 4 and 7, when the electric switching valve 40 is in the blocked state, fluid communication between the flow-in and flow-out pipes 31, 32 is blocked by the valve gate 42 of the electric switching valve 40. As shown in FIGS. 5 and 9, when the electric switching valve 40 is in the communicated state, the flow-in and flow-out pipes 31, 32 are fluidly communicated with each other through the communication hole 421 of the valve gate 42 of the electric switching valve 40.

As illustrated in FIGS. 1 to 3, the manual switching valve 50 is connected in series between the first and second bypass pipes 33, 34. In the first embodiment, the manual switching valve 50 includes a valve body 51 which is disposed in the installation space 111, and a manual switch 52 which is connected to the valve body 51 and which is disposed to extend out of a first hole 121 of the cover plate 12 to be exposed from the cover plate 12.

Figure 10:
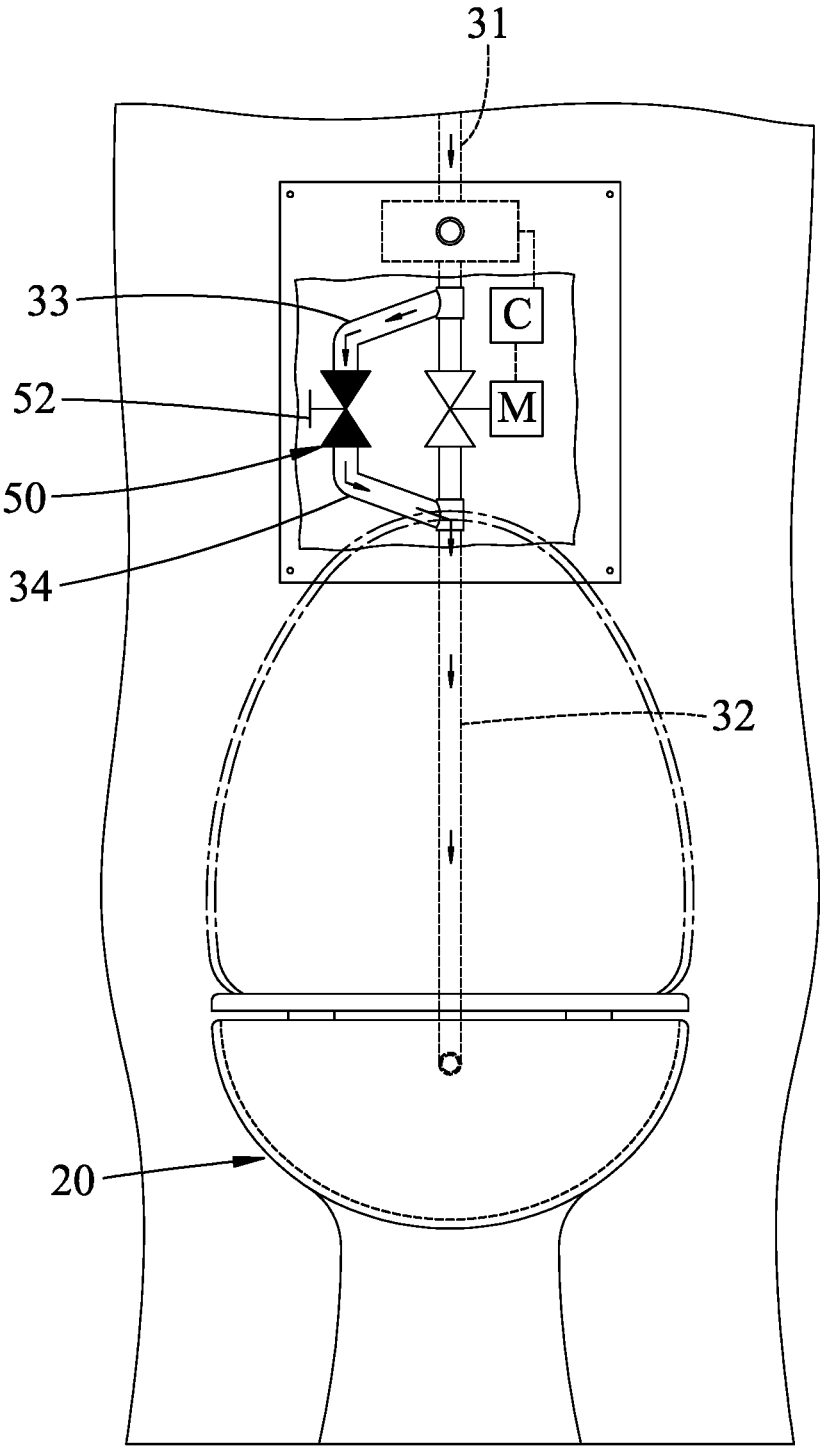
FIG. 10 is similar to FIG. 7 but the electric switching valve in the blocked state and the manual switching valve in an open state.

By operating the manual switch 52, the manual switching valve 50 can be controlled to switch between a closed state (FIG. 7) and an open state (FIG. 10). As shown in FIG. 7, when the manual switching valve 50 is in the closed state, fluid communication between the first and second bypass pipes 33, 34 is closed by the manual switching valve 50. As shown in FIG. 10, when the manual switching valve 50 is in the open state, the first and second bypass pipes 33, 34 are fluidly communicated with each other through the manual switching valve 50.

As shown in FIGS. 1 to 3, the sensor control unit 60 is disposed for controlling the switch of the electric switching valve 40 between the blocked state (FIGS. 4 and 7) and the communicated state (FIGS. 5 and 9).

In the first embodiment, the sensor control unit 60 includes a sensor 61 which is disposed on an inner surface of the cover plate 12, and a microcomputer control device 62 which is disposed on the electric switching valve 40. The sensor 61 is an ultrasonic sensor or an infrared sensor. The microcomputer control device 62 may be integrally formed with the drive motor 43 of the electric switching valve 40. The sensor 61 has a sensor head 611 which is disposed to extend out of a second hole 122 of the cover plate 12 to be exposed from the cover plate 12. The microcomputer control device 62 is in signal communication with the sensor 61 and the drive motor 43 of the electric switching valve 40 so as to permit a signal received from the sensor 61 to be transmitted to the drive motor 43 of the electric switching valve 40. In an embodiment, the microcomputer control device 62 may be set to transmit a signal to the drive motor 43 a predetermined time (for example, 3 seconds) after the microcomputer control device 62 has received a signal from the sensor 61. Furthermore, the microcomputer control device 62 may be set to keep the electric switching valve 40 in the communicated state for a predetermined time period (for example, 5 to 10 seconds), thereby controlling a water amount for flushing the toilet bowl 21.

Figure 6:
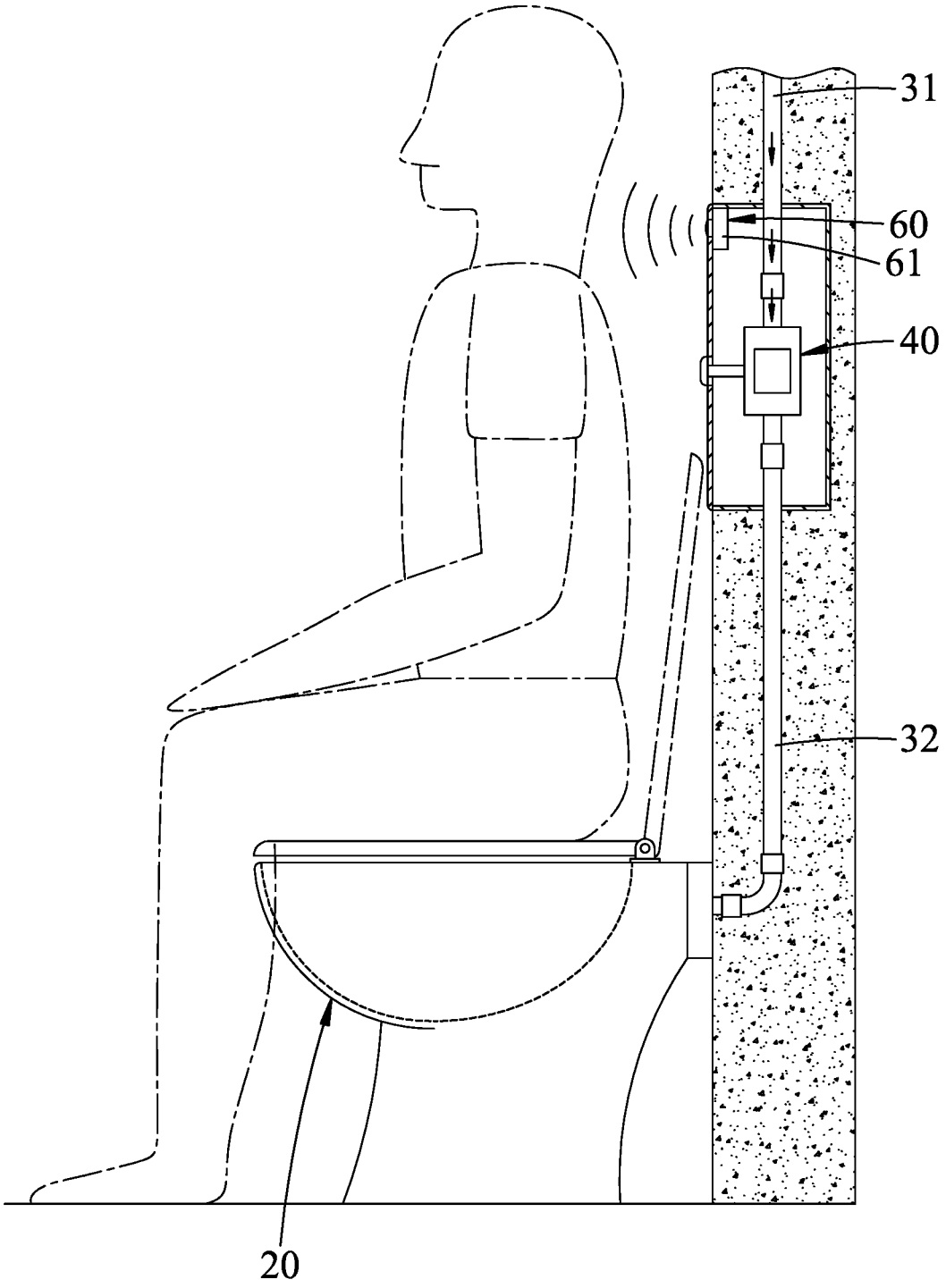
FIG. 6 is similar to FIG. 3 but illustrating a sensor control unit detecting a user on a toilet stool.

As shown in FIGS. 6 and 7, when the sensor control unit 60 detects a user sitting on the toilet stool 20, the sensor 61 transmits a signal to the microcomputer control device 62, and thereafter, the microcomputer control device 62 transmits a signal to the drive motor 43. At this point, the electric switching valve 40 is kept in the blocked state, and the manual switching valve 50, in an unoperated condition, will be kept in the closed state. As such, the water in the flow-in pipe 31 cannot flow into the flow-out pipe 32 through the electric switching valve 40 or through the first bypass pipe 33, the manual switching valve 50, and the second bypass pipe 34.

Figure 8:
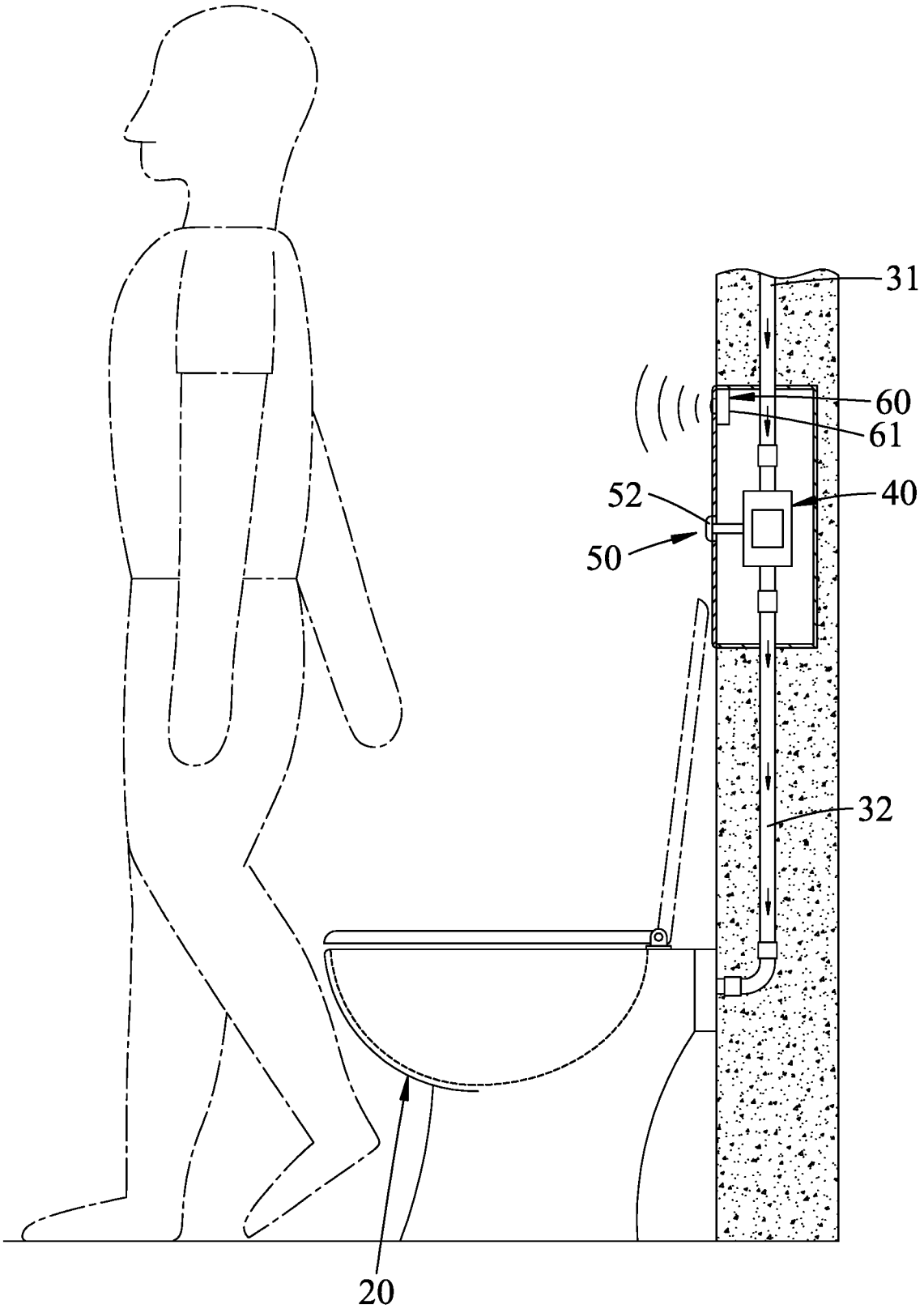
FIG. 8 is similar to FIG. 6 but illustrating the sensor control unit detecting leaving of a user from the toilet stool.

As shown in FIGS. 8 and 9, after the sensor 61 of the sensor control unit 60 detects a user leaving the toilet stool 20, the sensor 61 transmits a signal to the microcomputer control device 62. The microcomputer control device 62 may be set to transmit a signal to the drive motor 43 a predetermined time (for example, 3 seconds) after the microcomputer control device 62 received the signal from the sensor, so as to switch the electric switching valve 40 to the communicated state. As such, the water from the flow-in pipe 31 can flow into the flow-out pipe 32 through the electric switching valve 40 for flushing away excreta inside the toilet bowl 21. After a flushing time period, the microcomputer control device 62 emits a signal to switch the electric switching valve 40 back to the blocked state (FIG. 7) so as to stop the flushing. The flushing time period (for example, 5 to 10 seconds) is determined by the time period during which the electric switching valve 40 is kept in the communicated state, and can be controlled by the microcomputer control device 62 to thereby control the water amount for the flushing.

Under a blackout condition, a user can manually operate the manual switch 52 of the manual switching valve 50 shown in FIG. 8 to switch the manual switching valve 50 to the open state (FIG. 10). In this case, the water from the flow-in pipe 31 can flow into the flow-out pipe 32 through the first bypass pipe 33, the manual switching valve 50, and the second bypass pipe 34, thereby flushing excreta inside the toilet bowl 21. After the user releases the manual switch 52, the manual switching valve 50 will return to the closed state (FIG. 7) to stop the flushing.

Illustrative advantages of the tank-less automatic flush toilet 100 are summarized as follows:

(1) With the provision of the pipe unit 30 in cooperation with the electric switching valve 40 and the manual switching valve 50, the water flow in the pipe unit 30 can be used for directly flushing the toilet bowl 21. Compared to the conventional flush toilet with a water tank, the tank-less automatic flush toilet 100 can omit the water tank for saving the toilet space, and for improving the sense of space of the toilet.

(2) The sensor control unit 60 can control the electric switching valve 40 to switch between the blocked state and the communicated state, to thereby achieve the automatic flushing effect of the tank-less automatic flush toilet 100.

(3) Under a blackout condition, the manual switching valve 50 can be manually switched to the open state for flushing the toilet bowl. Thus, the tank-less automatic flush toilet 100 of the disclosure is still workable under a blackout condition.

(4) The communication hole 421 of the valve gate 42 of the electric switching valve 40 has a dimension the same as an inner diameter of each of the flow-in and flow-out pipes 31, 32. Therefore, when the electric switching valve 40 is switched to the communicated state, a sufficient amount of water from the flow-out pipe 32 can be provided for flushing the toilet bowl 21.

(5) The microcomputer control device 62 of the sensor control unit 60 may be set to control the time period during which the electric switching valve 40 is kept in the communicated state, thereby controlling the flushing time period and the water amount for flushing. Therefore, the provision of the microcomputer control device 62 may be useful for water-saving.

Figure 11:
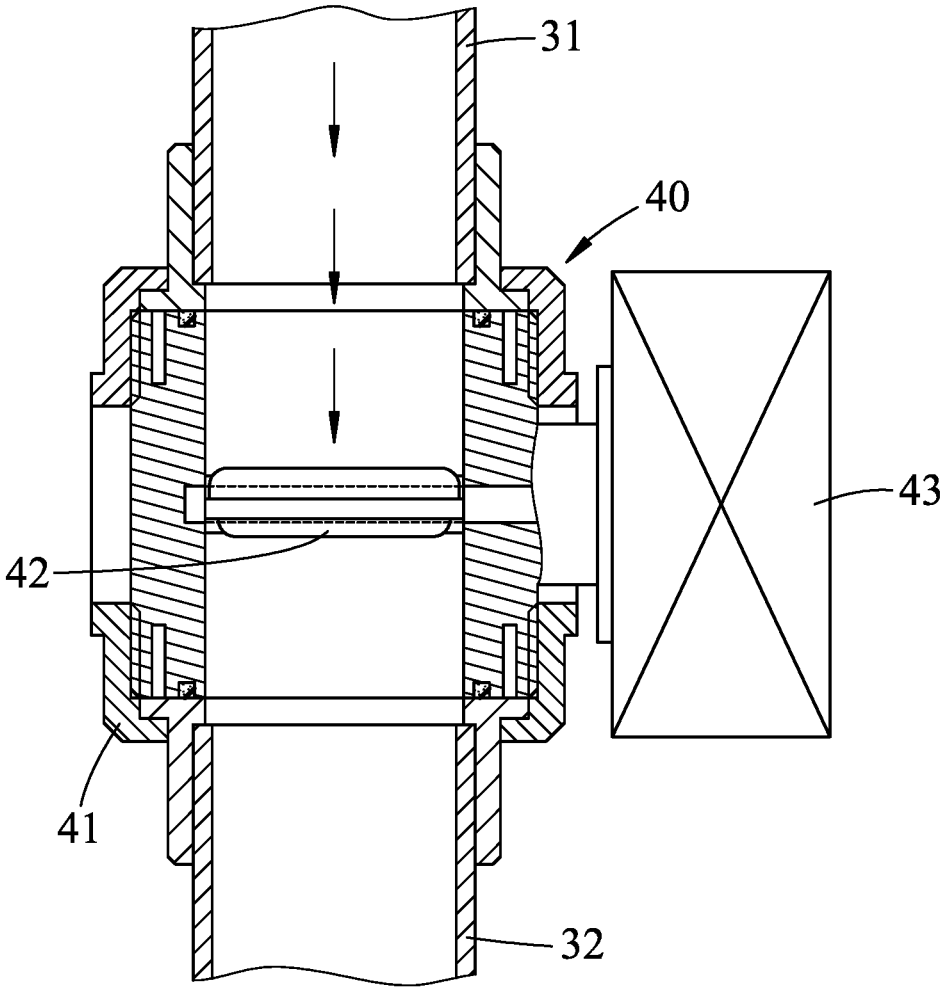
FIG. 11 is similar to FIG. 4 but illustrating an alternative configuration of the electric switching valve in the blocked state.
Figure 12:
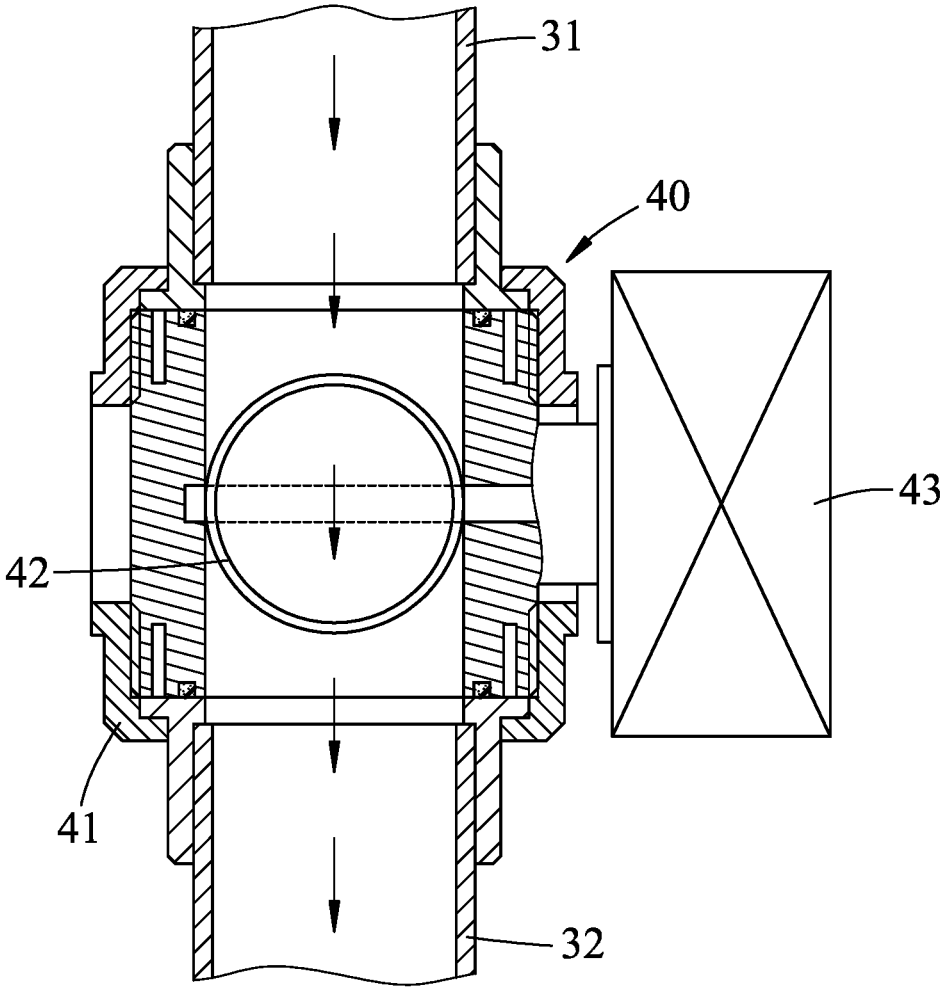
FIG. 12 is similar to FIG. 11 but illustrating the alternative configuration of the electric switching valve in the communicated state.
Figure 13:
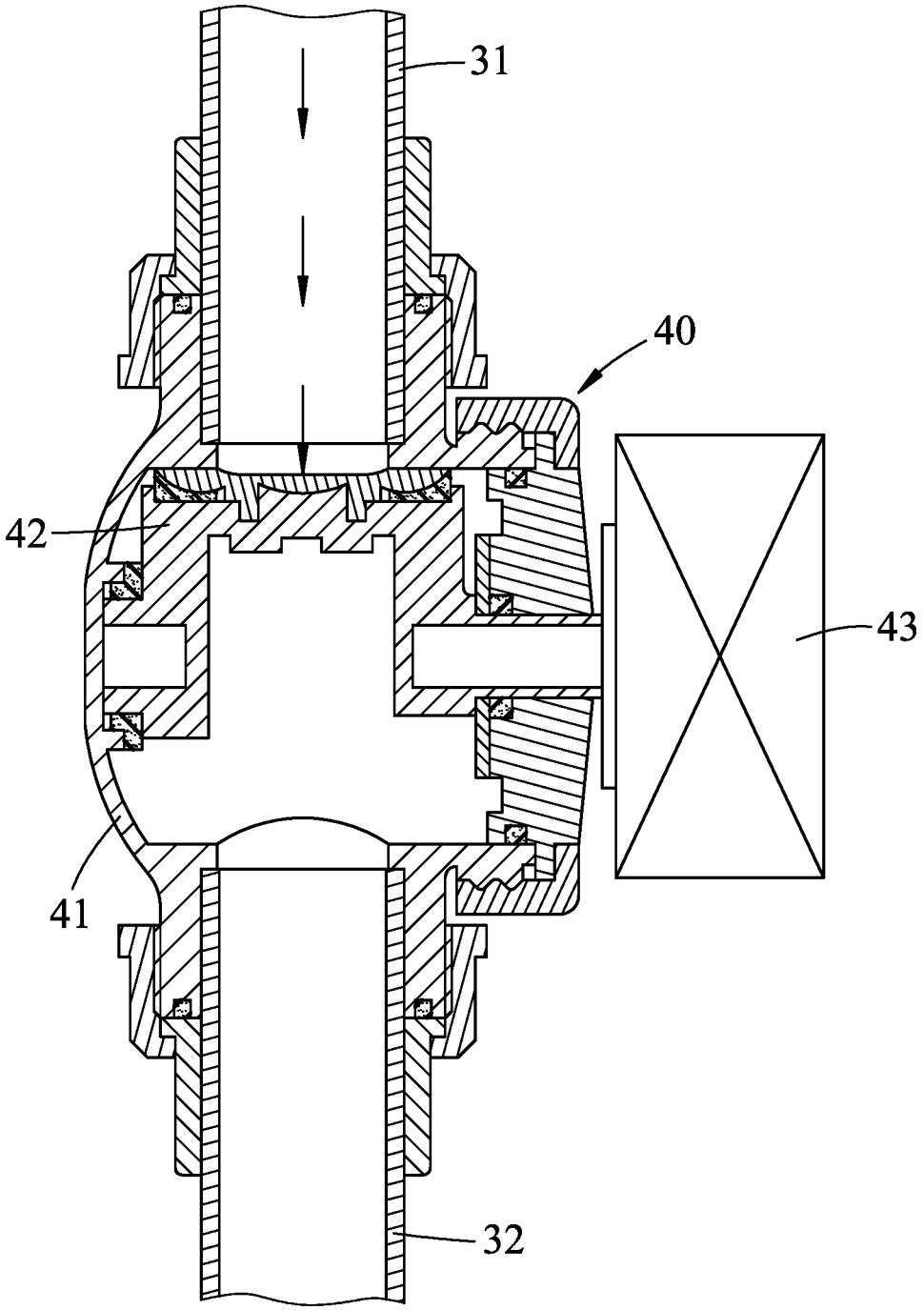
FIG. 13 is similar to FIG. 4 but illustrating another alternative configuration of the electric switching valve which is in the blocked state.
Figure 14:
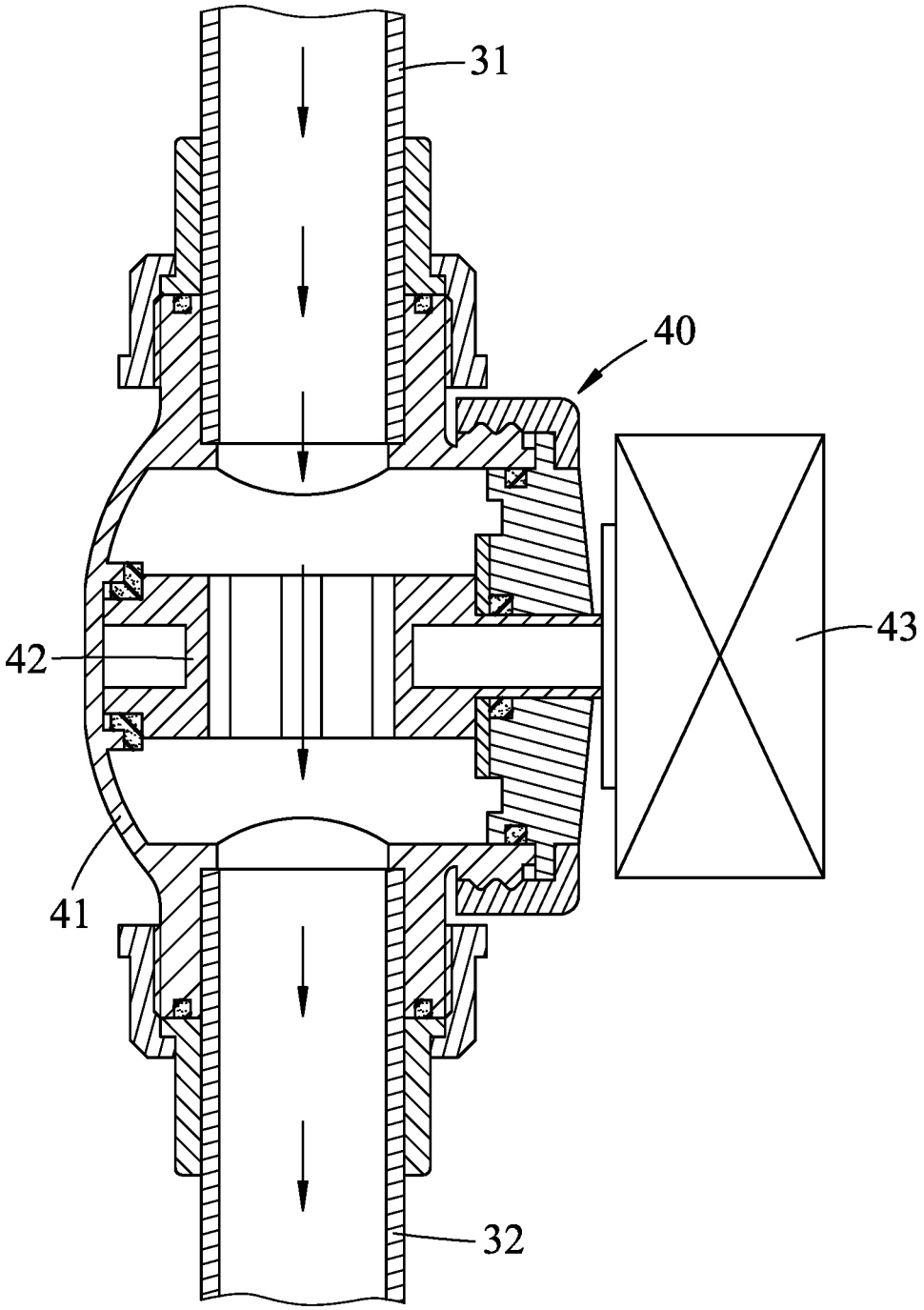
FIG. 14 is similar to FIG. 13 but illustrating the another alternative configuration of the electric switching valve in the communicated state.

In an alternative configuration of the first embodiment, as shown in FIGS. 11 and 12, the electric switching valve 40 is an electric rotary valve with the valve gate 42 in the form of a disc, and is also switchable between the blocked state (FIG. 11) and the communicated state (FIG. 12). In another alternative configuration, as shown in FIGS. 13 and 14, the electric switching valve 40 is an electric plunger valve with the valve gate 42 in the form of a plunger, and is similarly switchable between the blocked state (FIG. 13) and the communicated state (FIG. 14).

Figure 15:
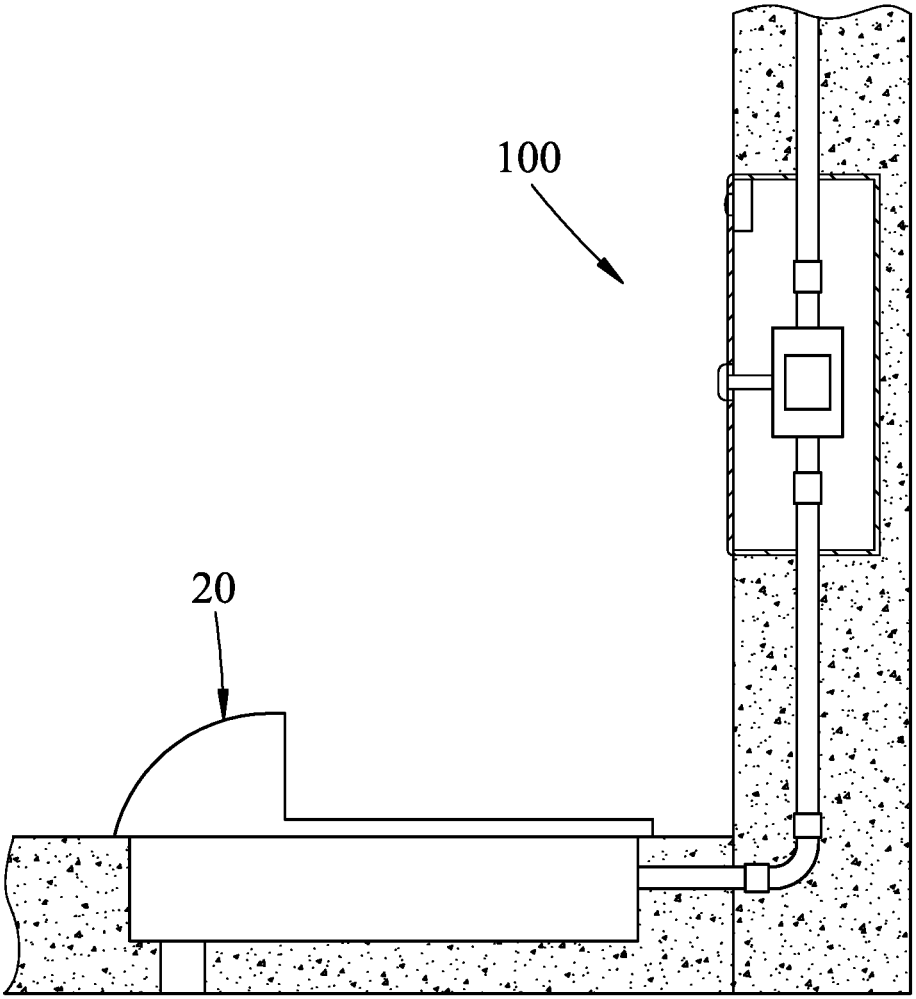
FIG. 15 is a fragmentary, partially cross-sectional view of a wall and a tank-less automatic flush toilet according to a second embodiment of the disclosure.

FIG. 15 illustrates a tank-less automatic flush toilet 100 according to a second embodiment of the disclosure. The second embodiment is similar to the first embodiment except that the toilet stool 20 is in the form of a squat toilet. The second embodiment may have advantages of the first embodiment.

In sum, the tank-less automatic flush toilet 100 of the disclosure is space-saving, will flush automatically, and is also workable under a blackout condition.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A tank-less automatic flush toilet, comprising:

a toilet stool defining therein a toilet bowl;

a pipe unit including a flow-in pipe, a flow-out pipe which is upstream of said toilet bowl, a first bypass pipe which is fluidly connected to said flow-in pipe, and a second bypass pipe which is fluidly connected to said flow-out pipe;

an electric switching valve which is connected in series between said flow-in and flow-out pipes, and which is switchable between a blocked state, where fluid communication between said flow-in and flow-out pipes is blocked, and a communicated state, where said flow-in and flow-out pipes are fluidly communicated with each other;

a manual switching valve which is connected in series between said first and second bypass pipes, and which is switchable between a closed state, where fluid communication between said first and second bypass pipes is closed, and an open state, where said first and second bypass pipes are fluidly communicated with each other;

a sensor control unit disposed for controlling a switch of said electric switching valve between the blocked state and the communicated state, said sensor control unit including a sensor, and a microcomputer control device which is in signal communication with said sensor and said electric switching valve; and an embedded box having a box body which defines therein an installation space, and a cover plate which is detachably mounted to said box body, wherein said flow-in pipe extends downwardly into said installation space;

wherein said flow-out pipe extends upwardly into said installation space;

wherein said first and second bypass pipes and said electric switching valve are disposed in said installation space;

wherein said manual switching valve includes a valve body which is disposed in said installation space, and a manual switch which is connected to said valve body and which is exposed from said cover plate;

wherein said sensor is disposed on an inner surface of said cover plate, and has a sensor head which is exposed from said cover plate;

wherein said microcomputer control device is disposed on said electric switching valve;

wherein said microcomputer control device is set to transmit a signal to said electric switching valve a first predetermined time after said microcomputer control device has received a signal from said sensor; and wherein said microcomputer control device is set to keep said electric switching valve in the communicated state for a second predetermined time, thereby controlling a water amount for flushing said toilet stool.

2. The tank-less automatic flush toilet according to claim 1, wherein said sensor is an ultrasonic sensor.

3. The tank-less automatic flush toilet according to claim 1, wherein said sensor is an infrared sensor.

4. The tank-less automatic flush toilet according to claim 1, wherein said electric switching valve is an electric ball valve.

5. The tank-less automatic flush toilet according to claim 1, wherein said electric switching valve is an electric rotary valve.

6. The tank-less automatic flush toilet according to claim 1, wherein said electric switching valve is an electric plunger valve.

7. The tank-less automatic flush toilet according to claim 1, wherein said toilet stool is in the form of a sitting toilet.

8. The tank-less automatic flush toilet according to claim 1, wherein said toilet stool is in the form of a squat toilet.

* * * * *